US007122970B2

(12) United States Patent
Ono et al.

(10) Patent No.: US 7,122,970 B2
(45) Date of Patent: Oct. 17, 2006

(54) METHOD FOR TESTING OLED SUBSTRATE AND OLED DISPLAY

(75) Inventors: Shinya Ono, Shiga (JP); Yoshinao Kobayashi, Shiga (JP)

(73) Assignees: Chi Mei Optoelectronics Corp., Tainan (TW); Kyocera Corporation, Kyoto (JP)

( * ) Notice: Subject to any disclaimer, the term of this patent is extended or adjusted under 35 U.S.C. 154(b) by 61 days.

(21) Appl. No.: 10/926,259

(22) Filed: Aug. 25, 2004

(65) Prior Publication Data

US 2005/0057193 A1 Mar. 17, 2005

(30) Foreign Application Priority Data

Aug. 27, 2003 (JP) ..... 2003-302752

(51) Int. Cl.
*G09G 3/10* (2006.01)
*G09G 3/30* (2006.01)

(52) U.S. Cl. ..... 315/169.3; 315/169.1; 315/169.2; 315/291; 345/76; 345/77; 345/82

(58) Field of Classification Search ..... 315/169.1, 315/169.2, 169.3, 169.4; 345/76–77, 82, 345/205

See application file for complete search history.

(56) References Cited

U.S. PATENT DOCUMENTS 6,424,326 B1 * 7/2002 Yamazaki et al. ..... 345/77
6,583,581 B1 * 6/2003 Kaneko et al. ..... 315/169.3
6,661,180 B1 * 12/2003 Koyama ..... 315/169.3
6,734,636 B1 * 5/2004 Sanford et al. ..... 315/169.3
6,738,034 B1 * 5/2004 Kaneko et al. ..... 345/76
2003/0160746 A1 * 8/2003 Yamazaki ..... 345/82
2003/0201727 A1 * 10/2003 Yamazaki et al. ..... 315/169.1
2004/0046718 A1 * 3/2004 Osame et al. ..... 345/80
2004/0196219 A1 * 10/2004 Kaneko et al. ..... 345/76
2005/0030265 A1 * 2/2005 Miyagawa ..... 345/76
2005/0078057 A1 * 4/2005 Chang et al. ..... 345/55

FOREIGN PATENT DOCUMENTS

JP 10-333641 12/1998
JP 2002-341825 11/2002

* cited by examiner

*Primary Examiner*—Thuy V. Tran
*Assistant Examiner*—Tung Le
(74) *Attorney, Agent, or Firm*—Milde & Hoffberg, LLP

(57) ABSTRACT

A method for testing an OLED substrate comprises: the first step of obtaining a first current value passing through a switching element group connected to a selection signal line; the second step of obtaining a second current value passing through a switching element group connected to a data signal line; and the third step of operating a current passing through each switching element including an OLED element from the current value for each pulse signal obtained by each of the steps 1 and 2.

7 Claims, 3 Drawing Sheets

Fig. 3 (a) Actual data

| | | | | J (y) |
|---|---|---|---|---|
| 15 | 16 | 17 | 19 | 67 |
| 16 | 18 | 19 | 20 | 73 |
| 17 | 18 | 19 | 20 | 74 |
| 48 | 52 | 55 | 59 | 214 |
| I (x) | | | | T |

Fig. 3 (b) Calculated value

| | | | |
|---|---|---|---|
| 15.0 | 16.3 | 17.2 | 18.5 |
| 16.4 | 17.7 | 18.8 | 20.1 |
| 16.6 | 18.0 | 19.0 | 20.4 |

Fig. 3 (c) Difference

| | | | |
|---|---|---|---|
| 0.0 | -0.3 | -0.2 | 0.5 |
| -0.4 | 0.3 | 0.2 | -0.1 |
| 0.4 | 0.0 | 0.0 | -0.4 |

METHOD FOR TESTING OLED SUBSTRATE AND OLED DISPLAY

BACKGROUND OF THE INVENTION

1. Field of the Invention

The present invention relates to a method for testing respective characteristics of a plurality of switching elements arranged on an OLED (Organic Light Emitting Diode) substrate and an OLED display equipped with means for correcting non-uniform characteristics of each switching element.

2. Description of Related Art

An OLED display has an OLED substrate having elements and wiring arranged on an insulating substrate. More particularly, in an OLED display, a plurality of switching elements and OLED elements are arranged on an insulating substrate in the form of matrix. Each switching element has a selection terminal and a data terminal. The selection terminals of the switching elements arranged in rows are connected to one selection signal line. The data terminals of the switching elements arranged in columns are connected to one data signal line. There are a plurality of selection signal lines and data signal lines, which cross each other. An OLED display emits OLED elements selected by each switching element to show the OLED elements. Thin film transistors (TFT) are used as switching elements.

Amorphous silicone and polysilicon are used as semiconductor materials for these thin film transistors. Thin film transistors made from amorphous silicon do not have so remarkable nonuniformity in characteristics, so that unevenness of display is dispersed to the whole screen. On the contrary, polysilicon made by local heating with laser irradiation tends to have non-uniform characteristics per unit of pixel.

These switching elements cause non-uniform luminance in OLED elements due to non-uniform characteristics. As a result, display quality is uneven. It follows that stabilizing characteristics of switching elements is important.

However, the number of switching elements is dramatically increased when the display size gets bigger. Consequently, it is difficult to improve characteristics of all switching elements.

Patent document 1 discloses a display for correcting luminance by measuring a load current of OLED elements in a current measurement circuit and correcting displayed data using its measurements.

Further, patent document 2 discloses a display for improving display quality by obtaining uniform quantity of emitted light per pixel and OLED substrate.

Patent document 1: Japanese Patent Publication No. 2002-341825

Patent document 2: Japanese Patent Publication No. 10-333641

Displays targeted for displaying moving picture become extremely deteriorated in picture quality when nonuniformity of emitted light luminance is locally concentrated on the screen. Thin film transistors using amorphous silicon which tend to disperse nonuniformity in characteristics onto the whole screen are employed as switching elements. Switching rate and threshold voltage are important out of the characteristics of switching elements because luminance nonuniformity occurs when the threshold voltage is dispersed.

The display disclosed in patent document 1 detects a current passing through switching elements, that is, OLED elements to control the signal level provided to data signal lines based on this detected current.

An additional circuit is, however, needed between an OLED substrate and a driver integrated circuit (IC) for providing data signal lines with data. An additional circuit comprises a current measuring part, a memory for storing measured current values, an operation part for operating the quantity to be corrected, a D/A converter for converting digital data outputted from the operation part to analog data. An additional circuit is required for each data signal line. This raised a problem of high costs for additional circuits.

The display disclosed in patent document 2 also needs a picture signal memory for storing a picture signal, an arithmetic circuit for processing a signal from the memory, a plurality of sub-frame memories for storing a plurality of sub-frame data outputted from the arithmetic circuit, and a read out circuit for reading particular frame data from the sub-frame memories or the like. Accordingly, there was a problem that the circuit of the display became complicated.

Moreover, the display needs a long test time for testing all pixels and a large-capacity memory to store data.

SUMMARY OF THE INVENTION

An OLED substrate comprises: an insulating substrate; a plurality of selection signal lines arranged on the insulating substrate; a plurality of data signal lines arranged so as to cross the selection signal lines; switching elements respectively having a selection terminal and a data terminal at each intersection area of a selection signal line and a data signal line; OLED elements where data is provided after being selected by the switching elements; and a plurality of common control lines wherein a voltage in accordance with light emitted by the OLED elements is applied. A method for testing an OLED substrate according to the present invention includes the steps 1 to 3. The first step is: (A) providing all data signal lines with a predetermined level of signal and (B) synchronizing a first pulse signal and a second pulse signal to respectively provide the selection signal lines and the common control lines with the synchronized signal sequentially while providing the signal, and obtaining a first current value passing through a switching element group connected to a selection signal line every time each pulse signal is provided. The second step is: (A) synchronizing the first and the second pulse signals to provide all selection signal lines and common control lines with the predetermined synchronized signal sequentially and (B) providing data signal lines with a third pulse signal sequentially while providing the synchronized signal, and obtaining a second current value passing through all switching elements connected to a data signal line. The third step is operating a current passing through each OLED element and each switching element from each current value for each pulse signal obtained from the first and the second steps. The current values passing through each switching element are determined by the above-mentioned steps 1 to 3.

Furthermore, an OLED display according to the present invention includes an OLED substrate, a memory, and an operation part. The OLED substrate comprises: an insulating substrate; a plurality of selection signal lines arranged on the insulating substrate; a plurality of data signal lines arranged so as to cross the plurality of selection signal lines; switching elements arranged at an intersection area of a selection signal line and a data signal line, which respectively have a selection terminal and a data terminal, wherein the selection terminal is connected to a selection signal line and a data terminal is connected to a data signal line; OLED elements selected by the switching elements, where data is provided; and a plurality of common control lines which a voltage corresponding to light emitted by the OLED element is applied to. The memory stores each characteristic data of switching elements. The operation part corrects a signal to provide the OLED substrate using characteristic data of the switching elements stored in the memory.

The method for testing an OLED substrate according to the present invention can determine a current value passing through OLED elements via each switching element using a small amount of data, which leads to learn the distribution status of the current of the whole OLED substrate. It is possible to obtain the electron mobility and the threshold voltage of each switching element by changing the level of the first pulse signal to be provided to the above-mentioned selection signal lines against the signal level to be provided to the data signal lines.

Moreover, the OLED display according to the present invention includes a memory for storing a current value passing through each switching element within the OLED substrate. This memory is capable of correcting uneven characteristics of each switching element per OLED substrate based on data stored in the memory. It follows that display quality of the entire screen is averaged.

BRIEF DESCRIPTION OF THE DRAWING

FIGS. 3(*a*) to 3(*c*) respectively show a table for showing current values.

DESCRIPTION OF THE PREFERRED EMBODIMENTS

Figure 1:
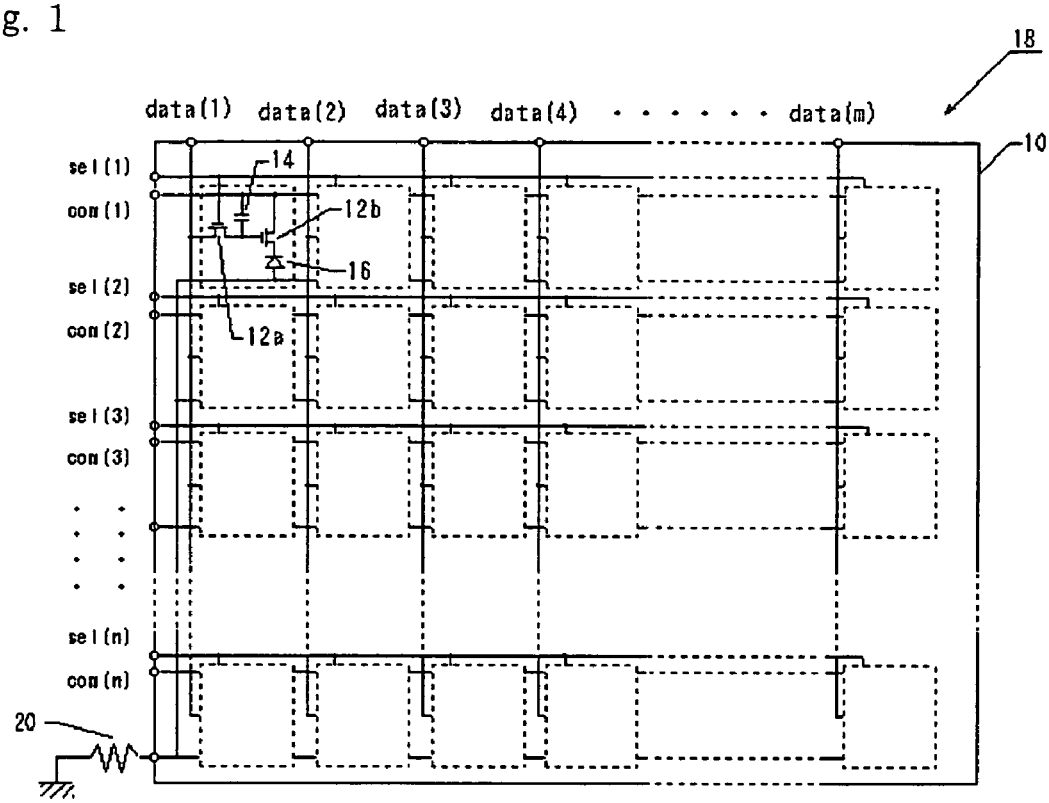
FIG. 1 is a plan view of one example of pixels of an OLED substrate.

The present invention will now be described in detail. In an OLED substrate, a plurality of switching elements respectively having a selection terminal and a data terminal, and OLED elements where data is provided after being selected by the switching elements are arranged on an insulating substrate in the form of matrix. Selection terminals of the switching elements arranged in rows are connected to one selection signal line. Data terminals of the switching elements arranged in columns are connected to one data signal line. There are a plurality of selection signal lines and data signal lines, where the data signal lines cross the selection signal lines. Further, an OLED substrate includes a plurality of common control lines for emitting light by the application of a voltage higher than the threshold value onto the OLED elements in selected rows. In the OLED substrate, only the OLED elements selected by the switching elements emit light at the luminance in accordance with a voltage applied onto the common control lines. On the other hand, a plurality of switching elements are connected to the selected switching element in rows and columns, but no current is passed through the OLED elements due to off status caused by no simultaneous transmission of pulse using the selection signal line and the data signal line.

It is assumed that a current value i (x, y) passing through the switching elements and the OLED elements of arbitrary x and y coordinates out of switching elements and OLED elements arranged in matrix is expressed as i (x, y)=f(x)·g(y) using functions f(x) and g(y). When a switching element of arbitrary x and y coordinates is selected, I (x) represents a total current value passing through a plurality of switching elements in y row. The total current value passing through all of the switching elements in x column in the state that a plurality of switching elements are simultaneously switched on is represented as J(y). The total current value I(x) in y column is $$I(x) = \sum_x i(x, y) = \sum_x f(x)\cdot g(y) = g(y)\sum_x f(x) \quad \text{(Equation 1)}$$

The total current value J(y) in x column is $$J(y) = \sum_y i(x, y) = \sum_y f(x)\cdot g(y) = f(x)\sum_y g(y) \quad \text{(Equation 2)}$$

And total T of currents passing through the entire OLED substrate is $$T = \sum_{x,y} i(x, y) = \sum_{x,y} f(x)\cdot g(y) = \sum_x f(x)\cdot \sum_y g(y) \quad \text{(Equation 3)}$$

When g(y) determined from the above-mentioned Equation 1 and f(x) determined from Equation 2 are substituted into Equation 3, $$i(x, y) = f(x)\cdot g(y) = \frac{I(x)}{\sum_x f(x)}\cdot\frac{J(y)}{\sum_y g(y)} = \frac{I(x)\cdot J(y)}{T} \quad \text{(Equation 4)}$$

is obtained.

This Equation 4 represents that current i (x, y) passing through the switching elements and OLED elements at arbitrary x and y coordinates is determined from the current value I(x) in y row, the total current value J(y) in x column, and the total current T passing through the entire OLED substrate.

On the other hand, gate/source voltage of switching elements is represented as Vgs. The coefficient proportional to the electron mobility is represented as β (x, y). The threshold voltage is represented as Vth (x, y).

Current i (x, y) passing through the switching elements is expressed as the following Equation 5:

$$i(x, y) = \frac{\beta(x, y)}{2}(V_{gs} - Vth(x, y))^2 \quad \text{(Equation 5)}$$

The designated total current value I (x) in y row and total current value J (y) in x column are determined by designating different coordinates at 2 points or more to change the gate/source voltage Vgs for each coordinate. This determines a current value between the designated coordinates, which enables to determine the coefficient β (x, y) proportional to the electron mobility and the threshold voltage (x, y).

EXAMPLE 1

Preferred embodiments of the present invention are described below. FIG. 1 shows an OLED display and the reference character 10 is an insulating substrate, the reference characters 12*a* and 12*b* are a pair of first and second switching elements (MOSFET shown in the figure). A gate electrode of the first switching element 12*a* is referred to as a selection terminal. And a source electrode is referred to as a data terminal for providing data. A drain electrode is connected to a gate electrode of the second switching element 12*b*. The reference character 14 is a condenser for data retention whose one end is connected to a connection point of the first switching element 12*a* and the second switching element 12*b*.

The other end of the condenser 14 is connected to the source electrode of the second switching element 12*b* to be a common terminal. The reference character 16 is an OLED element wherein a cathode electrode is connected to the drain electrode of the second switching element 12*b* and an anode electrode is used as an earth terminal. A plurality of the above-mentioned switching elements 12*a* and 12*b*, condensers 14, and OLED elements 16 are arranged on the insulating substrate 10 in the form of matrix. The selection terminals of the switching elements arranged crosswise (in rows) are connected to one of the selection signal lines sel (1) to sel (n). On the other hand, the common terminals are connected to one of the common control lines com (1) to com (n). The data providing terminals of the switching elements 12*a* arranged in a vertical direction (in columns) are connected to one of data signal lines data (1) to data (m) which cross the selection signal lines. Anode electrode of all OLED elements 16 are connected to one earthing wire GND. The earthing wire GND of an OLED substrate 18 is connected to ground via resistance 20 for current detection and provide a pulse signal in each step shown in FIGS. 2(*a*) and 2(*b*) to detect a current passing from voltage among terminals of resistance 20.

Figure 2:
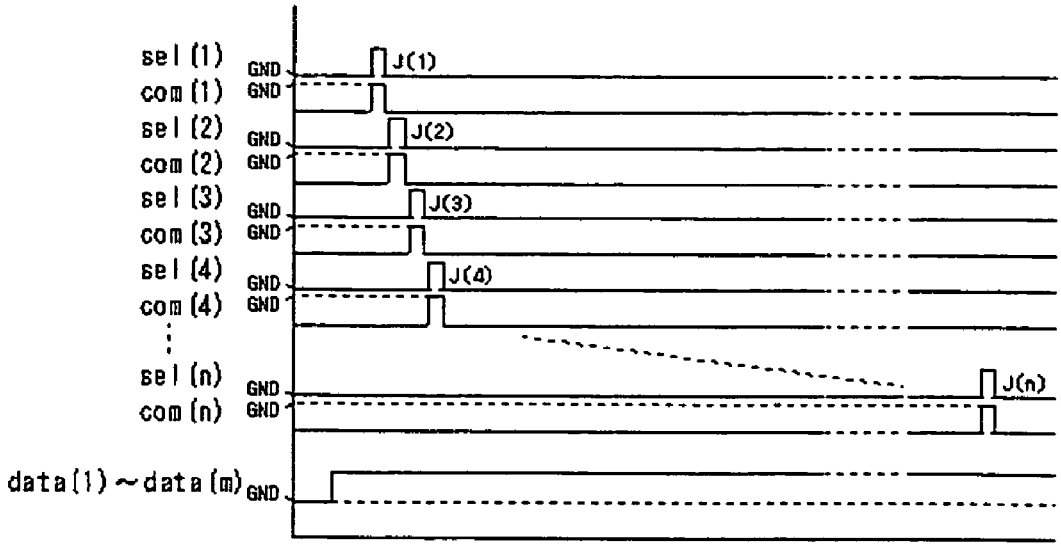
FIGS. 2(*a*) and 2(*b*) respectively show a wave form chart of a pulse signal provided to the substrate shown in FIG. 1.
Figure 2:
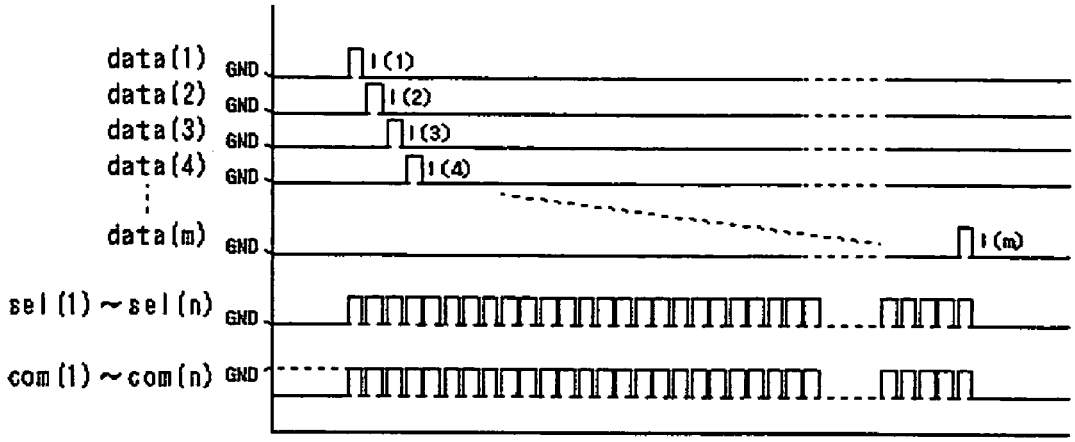

(First step) First, as shown in FIG. 2(*a*), a first pulse signal is provided to respective selection signal line sel (1) to sel (n) sequentially while providing a predetermined level of signals to all data signal lines data (1) to data (m). A second pulse signal is provided to common control lines com (1) to com (m) sequentially in synchronization with the first pulse signal. A plurality of switching elements connected to one line are referred to as group. A first current value passing through a switching element group connected to the selection signal lines sel (1) to sel (n) is obtained at each time providing the first and second pulse signals. These current values are represented as J (1) to J (n).

(Second step) Next, as shown in FIG. 2(*b*), the first pulse signal is provided to all of the selection signal lines sel (1) to sel (n) sequentially and the second pulse signal is provided to all of the common control lines com (1) to com (m) sequentially in synchronization between the first pulse signal and the second pulse signal. In this state, a third pulse signal is provided to the data signal lines data (1) to data (m) sequentially to obtain a second current value passing through a switching element group connected to the data signal lines data (1) to data (m). These current values are represented as I (1) to I (m).

(Third step) A current passing through each switching element 12 including an OLED element 16 from the current values J (1) to J (n) and I (1) to I (m) for each pulse signal of each group obtained by the first and the second steps. For example, the number of pixels is set at 1,024 across and 768 down in an XGA display, so that the total number of pixels is 2,359,296. However, the number of pixels is presented as 4 across and 3 down to simplify the description. Current values (true values) for each coordinate are displayed on the screen of the display as shown in FIG. 3(*a*).

Although current values for each pixel are unknown in the present invention, the first current values J (1) to J (3) passing through the switching element group are determined from the first step. And the second current values I (1) to I (4) are determined from the second step. Total value T of currents passing through all pixels is determined using any one of the groups of current value. A current value for each pixel position is calculated from the equation of i (x, y)=I (x)×J (y)/T in the third step. For example, the current value of 1 and 1 coordinates on the top right of the screen is 67×48/214=15.0 from the equation of I (1, 1)=I (1)×J (1)/T. Current values of other coordinates can be calculated in the same manner and each current value is as shown in FIG. 3(*b*). As shown in FIG. 3(*c*), since the difference between these calculated values and true values is very small, the calculated values may be usable instead of the true values for each coordinate. In the case of a color display having the aspect ratio of 3:4 and 1,024 pixels in rows, it is needed to test 1,024×3×768 (total number of pixels: 2,359,296) coordinates. On the contrary, the testing method of the present invention tests only (1,024×3+768+1)×2 (Total number of data: 7,682), which results in about 1/300 compared with testing all coordinates. The present invention enables shorter testing time and lower-capacity memory for storing test data, so that remarkable effects appear on displays with higher definition.

In the testing method according to the present invention, it is not needed to detect a current for each selection signal line and data signal line but is needed only to detect a voltage among terminals of resistance 20 connected to earth terminals to which OLED elements 16 are connected. The present invention only needs a simple testing device because pulse signals for testing can be easily generated by a personal computer or the like.

EXAMPLE 2

A pulse signal shown in FIG. 2(*a*) is provided to an OLED display substrate 18 shown in FIG. 1. A first pulse signal (level: Vg1) is provided to respective selection signal lines sel (1) to sel (n) sequentially while proving all data signal lines data (1) to data (m) with a predetermined level of signal and then a second pulse signal is sequentially provided to common control lines com (1) to com (n) in synchronization between the first and second pulse signals. This applies a voltage in accordance with the difference of the signal provided to the first pulse signal and the data signal line between the gate/source of the switching element 12*a*. Each time the first and the second pulse signals are provided, current values J1 (1) to J1 (n) passing through the switching element group connected to the selection signal lines sel (1) to sel (n) are obtained.

A pulse signal shown in FIG. 2(*b*) is provided. A third pulse signal is provided to the data signal lines data (1) to data (m) sequentially while providing all of the selection signal lines sel (1) to sel (n) with the first pulse signal (level: Vg1) and providing all of the common control lines com (1) to com (n) with the second pulse signal in synchronization of these signals.

Therefore, a voltage in accordance with the difference of the third pulse signal provided to the first pulse signal and the data signal lines is applied between the gate/source of the switching element 12*a* to obtain the second current values I1 (1) to I1 (m) passing through the switching element group connected to the data signal lines data (1) to data (m).

Only the level of the first pulse signal to be provided to the selection signal lines out of the pulse signals shown in FIG. 2 (*a*) is set at a predetermined level Vg2 between 90% to 50% without any change of other conditions to obtain again the first current values J2 (1) to J2 (n) passing through the switching element group.

After that, a pulse signal shown in FIG. 2(*b*) is provided. The first pulse signal (level: Vg2) is respectively provided to all of the selection lines sel (1) to sel (n) sequentially. And the second pulse signal is synchronized with the first pulse signal to be provided to all of the common control lines com (1) to com (n)sequentially. In this state, the third pulse signal is provided to the data signal lines data (1) to data (m) sequentially to obtain the second current values I2 (1) to I2 (m) passing through the switching element group connected to the data signal lines data (1) to data (m).

The current values for each coordinate are determined from the first current values J1 (1) to J1 (n) and the second current values I1 (1) to I1 (m) when proving a signal in level Vg1 as a first pulse signal.

The current values for each coordinate are determined from the first current values J2 (1) to J2 (n), the second current values I2 (1) to I2 (m), and total current value T when providing a signal in level Vg2 as a second pulse signal.

Current values of two coordinates arbitrarily selected are calculated from the above-mentioned Equation 4 and are obtained as a1 and a2 when providing the first pulse in level Vg1. The current values of these two coordinates are obtained as a3 and a4 when providing the first pulse in level Vg2.

The voltage between gate/source applied onto the first switching element 12*a* depends on the levels of the first pulse Vgs1 and Vgs2 that is a gate voltage because the level of the data signal to determine the source voltage is constant.

The current values of the selected coordinates a1 and a3 or a2 and a4 are substituted into the above-mentioned Equation 5, the threshold voltage Vth can be determined because the gate/source voltage Vgs of the switching element 12*a* is known. The coefficient β proportional to the electron mobility is determined by substituting this again into Equation 5. The result of substituting the current values a1 and a3 into Equation 5 is represented as Equation 6.

(Equation 6)

$$\frac{\beta}{2}(Vgs1 - Vth)^2 = a1 \quad (1)$$

$$\frac{\beta}{2}(Vgs2 - Vth)^2 = a3 \quad (2)$$

From (1)/(2)

$$\frac{(Vgs1 - Vth)^2}{(Vgs2 - Vth)^2} = \frac{a1}{a3} \quad (3)$$

$$\frac{(Vgs1 - Vth)}{(Vgs2 - Vth)} = \sqrt{\frac{a1}{a3}} \quad (4)$$

When $\sqrt{a1/a3} = k1$, (4) is $$\frac{(Vgs1 - Vth)}{(Vgs2 - Vth)} = k1 \quad (5)$$

-continued

From (5), *Vth* is $$Vth = \frac{Vgs1 - k1 \cdot Vgs2}{1 - k1} \quad (6)$$

EXAMPLE 3

Figure 4:
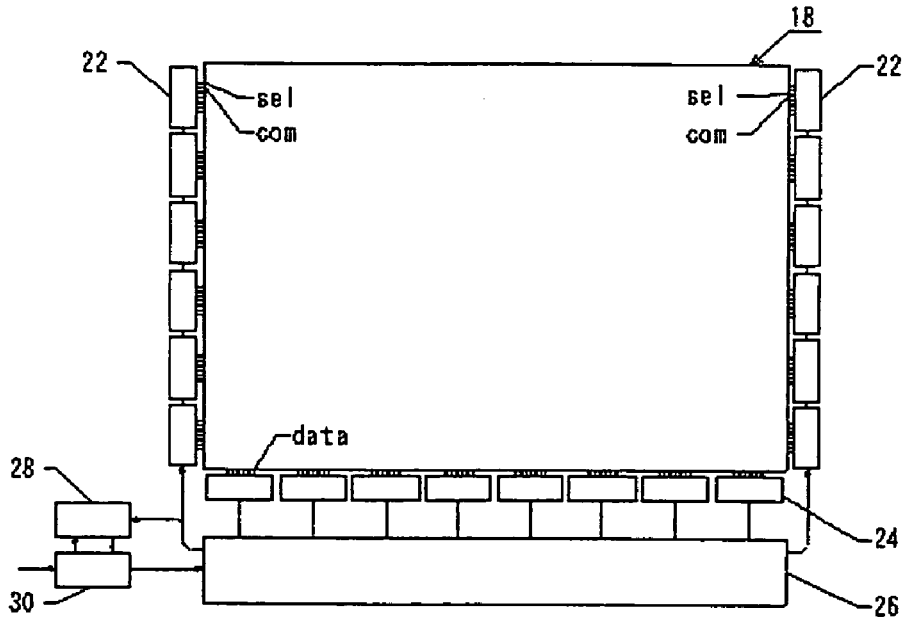
FIG. 4 is a block diagram of an OLED display according to the present invention.

FIG. 4 shows an OLED display of the present invention. In FIG. 4, overlapped description with FIG. 1 is omitted by using the same reference characters in the same portion. The reference characters 22 and 24 are driver integrated circuits (IC) arranged to the disposition marginal part of the OLED substrate 18 wherein a plurality of switching elements and OLED elements are arranged in the form of matrix. The driver IC (gate driver IC) 22 for driving selection signal lines sel and common control lines com is disposed on either both sides or one side of the OLED substrate 18. The data signal driver IC (source driver IC) 24 for driving data signal lines data is disposed on upper hem or lower hem of the OLED substrate 18.

The reference character 26 is a control IC for internally processing a picture signal provided from the outside. The control IC 26 comprises a shift register, a latch circuit, an analog data switch (not shown in figures) or the like, and provides each of driver IC 22 and 26 with a signal internally processed.

The reference character 28 is a memory for storing current values for each pixel obtained by the testing method of the present invention. The memory 28 stores data of the current values of I (1) to I (m) in rows and the current values of J (1) to J (n) in columns of the display screen. In the case of an XGA display, the number of pixels is set at 1,024 in rows and 768 in columns. And in the case of a color display, the data having the number of (1,024×3+768+1)×2=7,682 is stored.

The reference character 30 is an operation part for correcting the level of a picture signal based on data stored in the memory 28. The operation part 30 operates the current value i (x, y) passing through pixels of the coordinates x and y by the equation of I (x)×J (y)/T using the current value I (x) in rows, the current value J (y) in columns, and the total current value T obtained by that addition of current values in rows and columns. Further, the operation 30 respectively operates the coefficient β (x, y) proportional to the electron mobility and the threshold voltage Vth from Equation 6. And then the operation part 30 adjusts the level of the picture signal for each pixel based on these values.

This OLED display is capable of averaging current values of the entire screen by correcting the dispersion of the current values for each pixel arranged on the OLED substrate 18. Further, the OLED display is capable of improving and stabilizing display quality by correcting nonuniformity in switching elements and OLED elements arranged on the OLED substrate 18.

The memory 28 equipped with the display is designed to store tested data after the test of pixel current data of the OLED substrate 18 to be combined. This shortens the testing duration and enables a lower-capacity memory because the total number of data is represented as (number of pixels in rows×3+number of pixels in columns)×2.

Therefore, in the case of a display with high definition, for example, a U-XGA display, the total number of pixels is 5,760,000, but the number of data is only 12,002 when the number of pixel is 1,600×1,200 and the display is colored. Further, in the case of a Q-XGA display with high definition, the number of pixels is 2,048×1,536 and the total number of pixels is 9,437,184 when the display is colored, but the number of data is only 15,362. Compared with the number of pixels, as the definition of a display is higher, the shorter the testing time is, which leads to a lower-capacity of memory.

A thin film transistor is usually used as a switching element to select OLED elements and provide a data signal. A thin film transistor made from amorphous silicon has small nonuniformity in characteristics among adjacent transistors because the nonuniformity is dispersed onto the entire display screen.

The present invention is, therefore, preferably used for an OLED substrate wherein switching elements are made of amorphous silicon, particularly, preferably used for an moving picture display which needs to correct image moving at high speed.

There have thus been shown and described a novel method for testing OLED substrate and OLED display which fulfill all the objects and advantages sought therefor.

Many changes, modifications, variations, combinations, and other uses and applications of the subject invention will, however, become apparent to those skilled in the art considering this specification and accompanying drawings which disclose the preferred embodiments thereof. All such changes, modifications, variations and other uses and applications which do not depart from the spirit and scope of the invention are deemed to be covered by the invention, Which is to be limited only by the claims which follow. This application claims priority from Japanese Patent Application No. 2003-302752, which is incorporated herein by reference.

What is claimed is:

1. In a method for testing an OLED substrate comprising:

an insulating substrate;

a plurality of selection signal lines arranged on the insulating substrate;

a plurality of data signal lines arranged so as to cross the selection signal lines;

switching elements respectively having a selection terminal and a data terminal at each intersection area of the selection signal lines and the data signal lines;

OLED elements where data is provided via the switching elements; and a plurality of common control lines which apply a voltage in accordance with light emitted by the OLED elements, said method comprising;

the first step of providing the selection signal lines with a first pulse signal and then providing the common control lines with a second pulse signal in synchronization between the first and the second pulse signals while providing all of the data signal lines with a predetermined level of signal to obtain a first current value passing through a switching element group connected to a selection signal line at each time when providing respective pulse signals;

the second step of providing the data signal lines with a third pulse signal sequentially while providing all of the selection lines with the first pulse signal and then providing the common control lines with the second pulse signal in synchronization between the first and the second pulse signals to obtain a second current value passing through a switching element group connected to a data signal line; and the third step of operating a current passing through each switching element including an OLED element from current values for each pulse signal obtained by the first and the second step.

2. The method for testing an OLED substrate according to claim 1, comprising:

providing each selection signal line with a first pulse signal in a different level, respectively, and obtaining a first current value passing through a switching element group connected to a selection signal line in the first step; and providing all selection signal lines with a first pulse signal in a different level and obtaining a second current value passing through a switching element group connected to a data signal line to determine the electron mobility or the threshold voltage of the switching elements from each current value.

3. OLED display apparatus including an OLED substrate, said OLED substrate comprising:

an insulating substrate;

a plurality of selection signal lines arranged on the insulating substrate;

a plurality of data signal lines arranged so as to cross the selection signal lines;

a plurality of pixels arranged in a matrix, each of the pixels including a switching element and an OLED element, the switching element electrically connected to a selection signal line and a data signal line;

a memory configured to store a first data and a second data, the first data being current values of the pixels in each row, the second data being current values of the pixels in each column; and an operation part electrically connected to the memory, for calculating a third data based on the first data and the second data stored in the memory, the third data being correction data supplied to the data lines.

4. The OLED display apparatus according to claim 3, wherein said switching elements are amorphous silicon thin film transistors.

5. The OLED display apparatus according to claim 3, wherein the third data includes current values which are to be passed to each of the pixels.

6. In a method for testing an OLED display apparatus comprising:

an insulating substrate;

a plurality of selection signal lines arranged on the insulating substrate;

a plurality of data signal lines arranged so as to cross the selection signal lines;

a plurality of pixels arranged in a matrix, each of the pixels including an OLED element and a switching element electrically connected to the selection signal line and the data signal line; and a plurality of common control lines, each electrically connected to the OLED element in each of the pixels;

the first step of providing the selection signal lines with a first pulse signal and then providing the common control lines with a second pulse signal in synchronization while providing all of the data signal lines with a predetermined level of signal and obtaining a first current value passing through a switching element group connected to a selection signal line at each time when providing respective pulse signals;

the second step of providing the data signal lines with a third pulse signal sequentially while providing all of the selection signal lines with the first pulse signal and then providing the common control lines with the second pulse signal in synchronization and obtaining a second current value passing through a switching element group connected to a data signal line; and the third step of operating a current passing through each switching element including an OLED element from current values for each pulse signal obtained by the first and the second step.

7. The method for testing an OLED display apparatus according to claim 6, comprising:

providing each selection signal line with a first pulse signal in a different level, respectively, and obtaining a first current value passing through a switching element group connected to a selection signal line in the first step; and providing all selection signal lines with a first pulse signal in a different level, and obtaining a second current value passing through a switching element group connected to a data signal line to determine at least one of the electron mobility and the threshold voltage of the switching elements from each current value.

* * * * *